United States Patent [19]

Lew et al.

[11] Patent Number: 4,679,656

[45] Date of Patent: Jul. 14, 1987

[54] SKY-RIDE VERTICAL MOBILITY DEVICE

[76] Inventors: Hyok S. Lew; Hyon S. Lew; Yon K. Lew, all of 7890 Oak St., Arvada, Colo. 80005

[21] Appl. No.: 797,411

[22] Filed: Nov. 12, 1985

Related U.S. Application Data

[63] Continuation-in-part of Ser. No. 711,318, Mar. 13, 1985, which is a continuation-in-part of Ser. No. 682,673, Dec. 17, 1984, Pat. No. 4,598,792, which is a continuation-in-part of Ser. No. 676,400, Nov. 29, 1984, Pat. No. 4,598,793.

[51] Int. Cl.[4] ..... A62B 1/08

[52] U.S. Cl. ..... 182/42; 182/5; 182/72

[58] Field of Search ..... 182/42, 43, 5–7, 182/190–193, 71, 72, 236, 231; 188/65.1–65.5

[56] References Cited

U.S. PATENT DOCUMENTS

| | | | |
|---|---|---|---|
| 195,401 | 9/1877 | Riesdorph | 182/191 |
| 255,379 | 3/1882 | Darby | 182/142 |
| 383,432 | 5/1888 | Bernstein | 182/71 |
| 715,330 | 12/1902 | Zimmer | 182/42 |
| 2,576,531 | 11/1951 | Mitchell | 182/71 |

FOREIGN PATENT DOCUMENTS

| | | | |
|---|---|---|---|
| 542390 | 10/1929 | Fed. Rep. of Germany | 182/5 |
| 7521790 | 11/1977 | France | 182/5 |

*Primary Examiner*—Reinaldo P. Machado
*Assistant Examiner*—Alvin Chin-Shue

[57] ABSTRACT

This invention relates to a self-sufficient device enabling a person to descend and ascend with ease, which device includes a closed loop of cord depending from a frictionally controlled cord release device wherein a person secured to one member of the closed loop of cord depending from the frictionally controlled cord release device by means of a harness is able to controll one's descending speed by exerting a small amount of tension on the other member of the closed loop of cord in the descending process. In the ascending process, a person secured to one member of the closed loop of cord by a harness is able to elevate oneself by using a stirrup slidably secured to the other member of the closed loop of cord 1 which stirrup includes a locking means that grabs the other member of the closed loop of cord when one stands on the stirrup applying a weight thereon, while the stirrup slides substantially freely on the other member of the closed loop of cord when no weight is applied thereon. The person secured to one member of the closed loop of cord propels oneself upwards by repeating the combination of movements of pulling up the stirrup by bending the knees and standing up straight while shifting the body weight from the harness to the stirrup.

14 Claims, 11 Drawing Figures

SKY-RIDE VERTICAL MOBILITY DEVICE

This is a Continuation-In-Part application to patent application Ser. No. 711,318 entitled "Sky-Ride Vertical Mobility System" filed on Mar. 13, 1985, which is a Continuation-In-Part of Ser. No. 682,673 entitled "Sky-Ride Vertical Mobility System" filed on Dec. 17, 1984 U.S. Pat. No. 4,598,792 issued 7-8-86, which is a Continuation-In-Part of Ser. No. 676,400 entitled "Sky-Ride Emergency Escape System" filed on Nov. 29, 1984, U.S. Pat. No. 4,598,793 issued 7-8-86

BACKGROUND OF THE INVENTION

A light weight portable device that provides vertical mobility for a person or persons as well as an object or objects, can be very useful in a number of applications such as emergency rescue operations, industrial construction and maintenance operations, military operations, mountain climbing, spelunking, outdoor recreational activities, etc. Unfortunately, no such device exists at the present time, which is a self-sufficient and light-weight device that is usable by an average person without training and superb physical strength.

The primary object of the present invention is to provide a compact lightweight self-sufficient device that enables a person to lower and elevate oneself with ease.

Another object is to provide a vertical mobility device comprising a closed loop of cord depending from a frictionally controlled cord release device in a loopable relationship wherein the descending speed of a person or object secured to one member of the closed loop of cord can be easily controlled by exerting a small amount of tension on the other member of the closed loop of cord.

A further object is to provide a vertical mobility device comprising a stirrup slidably secured to the other member of the closed loop of cord depending from the frictionally controlled cord release device wherein the stirrup includes a locking means that grabs the cord member in a nonsliding relationship when the stirrup is stepped on by a person, while the stirrup slides substantially freely on the cord member when the weight of the person is shifted from the stirrup to the harness secured to one member of the closed loop of cord.

Yet another object is to provide a vertical mobility device wherein the harness secured to one cord member and the stirrup with locking means slidably secured to the other cord member are removable from the respective cord members.

Yet a further object is to provide a self-sufficient vertical mobility device that can be operated by a person using the device without requiring any assistance from others.

These and other objects of the present invention will become clear as the description thereof proceeds.

BRIEF DESCRIPTION OF FIGURES

The present invention may be described with great clarity and specificity by referring to the following figures.

DESCRIPTION OF THE ILLUSTRATED EMBODIMENTS

Figure 1:
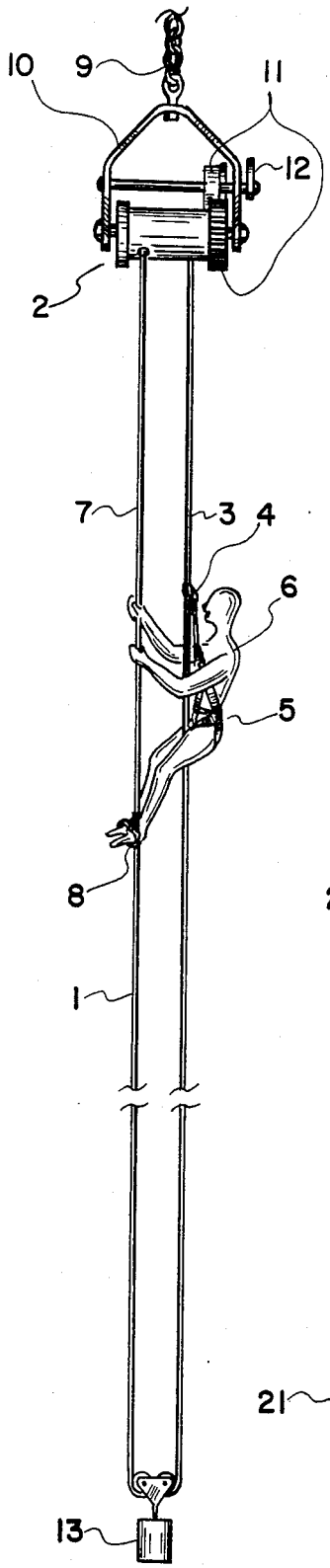
FIG. 1 illustrates an embodiment of the vertical mobility device employing one type of the frictionally controlled cord release device.

In FIG. 1 there is illustrated an embodiment of the vertical mobility device constructed in accordance with the principles of the present invention, which comprises a closed loop of cord 1 depending from a frictionally controlled cord release device 2 in a loopable relationship. One member 3 of the closed loop of cord 1 includes a securing means 4 which removably or permanently anchors a harness 5 supporting a person 6 or object, while the other member 7 of the closed loop of cord 1 includes a stirrup 8 slidably secured thereto, that includes a locking means which grabs the cord member 7 in a nonsliding relationship when the weight of the person 6 is shifted thereto from the harness 5, while the stirrup 8 is slidable substantially freely on the cord member 7 when the weight of the person is fully supported by the harness 5 secured to the cord member 3. The frictionally controlled cord release device 2 including means 9 for securing the device to an elevated structure comprises a cylindrical member on which the closed loop of cord 1 is wound over a plurality of laps, wherein the cylindrical member is supported by the frame 10 in relationship wherein the cylindrical member is rotatable in one direction only when the ratchet mechanism 11 with a manual switch 12 is activated, while the cylindrical member is rotatable in both directions when the ratchet mechanism 11 is deactivated. The detail of the construction of the frictionally controlled cord release device 2 is described in conjunction with FIGS. 3, 4, 5, 6, 7 and 8. A weight 13 is secured to the lower extremity of the closed loop of cord 1 in a sliding relationship. It should be understood that the vertical mobility device illustrated in FIG. 1 operates with or without the weight 13 and, consequently, it is strictly a matter of preference whether to include the weight 13 or not.

Figure 2:
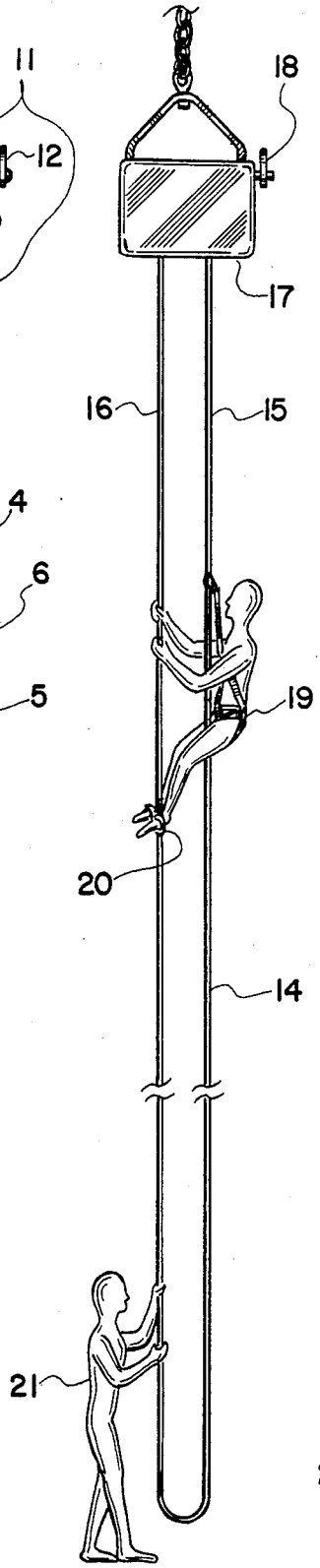
FIG. 2 illustrates another embodiment of the vertical mobility device employing the other type of the frictionally controlled cord release device.

In FIG. 2 there is illustrated another embodiment of the vertical mobility device comprising a closed loop of cord 14 including the two cord members 15 and 16, which depends from a frictionally controlled cord release device 17 including a ratchet mechanism with switch 18; a harness 19 secured to the cord member 15; and a stirrup with locking means 20 slidably secured to the cord member 16, wherein those elements are assembled in essentially the same way as the vertical mobility device illustrated in FIG. 1. The vertical mobility device illustrated in FIG. 2 does not include a weight equivalent to the element 13 of FIG. 1 as a person 21 on the lower level keeps the cord member 16 at a taut state.

Figure 3:
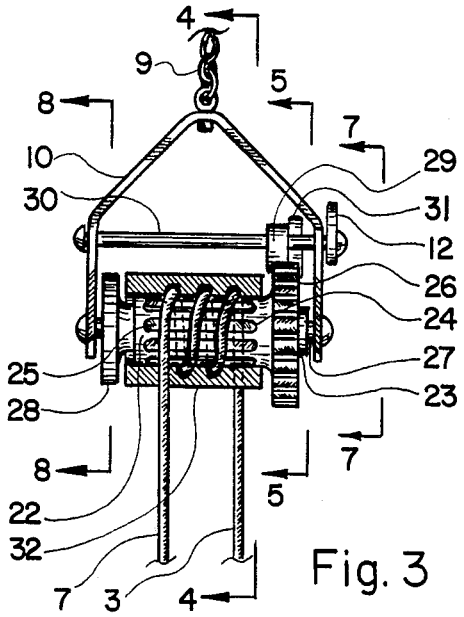
FIG. 3 illustrates an embodiment of a frictionally controlled cord release device employed in the vertical mobility device illustrated in FIG. 1.

In FIG. 3 there is illustrated the frictionally controlled cord release device 2 included in the vertical mobility device illustrated in FIG. 1. The hollow cylindrical member or capstan 22 rotatably mounted on the hollow brake cylinder 23 includes a plurality of cut-outs 24 disposed through the cylindrical wall thereof, which cut-outs are engaged by a plurality of brake pads 25 in a snug relationship. The combination of the hollow cylindrical member 22 and the plurality of the brake pads 25 will be called the squeezable tubular brake assembly. One extremity of the hollow cylindrical member 22 is nonrotatably connected to a ratchet gear or sprocket 26. The hollow brake cylinder 23 rotatably supporting the squeezable tubular brake assembly is mounted on a shaft 27 nonrotatably secured to the frame 10, wherein the hollow brake cylinder 23 is rotatable in one direction only that results in the release of the cord member 7 and take up of the cord member 4, while it is not rotatable in the other opposite direction due to the ratchet coupling 28 to be described in conjunction with FIG. 8. Depending on whether the ratchet stop 29 pivotably supported by the shaft 30 engages or disengages the teeth of the ratchet gear or sprocket 26, the squeezable tubular brake assembly is rotatable in one direction only resulting in the release of the cord member 7 and take up of the cord member 4 or rotatable in both directions. The engagement and disengagement of the ratchet stop 29 is controlled by means of the manual ratchet switch or shift mechanism 12 or by means of the remotely controlled ratchet switch 31, which control means are to be described in conjunction with FIGS. 5, 6 and 7. The cord member is wound on the squeezable tubular brake assembly comprising the hollow cylindrical member 22 and the plurality of the brake pads over at least one and one half complete laps, wherefrom the two portions of the cord member extend as the cord members 4 and 7. The tubular cord guide 32 with a helical guide groove guides the looping movement of the cord member associated with the rotating movement of the squeezable tubular brake assembly.

Figure 4:
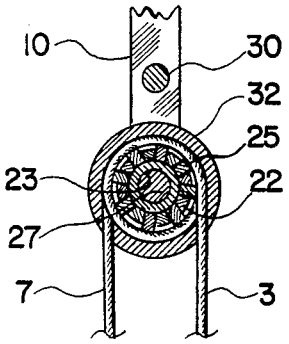
FIG. 4 illustrates a cross section of the frictionally controlled cord release device illustrated in FIG. 3.

In FIG. 4 there is illustrated a cross section of the frictionally controlled cord release device illustrated in FIG. 3, which cross section is taken along plane 4—4 as shown in FIG. 3. The construction of the squeezable tubular brake assembly comprising the hollow cylindrical member 22 and the plurality of the brake pads 25 are clearly illustrated in this cross section view. It is evident that the tension exerted on the cord member squeezes the plurality of the brake pads 25 against the cylindrical surface of the hollow brake cylinder 23 and, consequently, generates braking force of magnitude substantially proportional to the tension on the cord member, which braking force hinders the rotating movement of the squeezable tubular brake assembly relative to the hollow brake cylinder 23.

Figure 5:
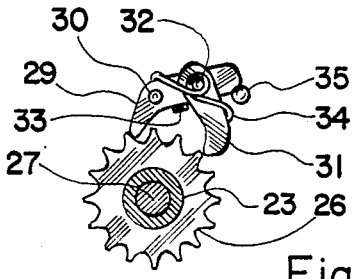
FIG. 5 illustrates another cross section of the frictionally controlled cord release device showing a ratchet mechanism at locked position.
Figure 6:
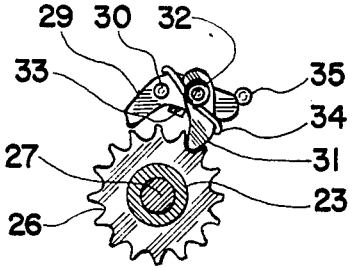
FIG. 6 illustrates the same cross section of the frictionally controlled cord release device as that illustrated in FIG. 5, showing a ratchet mechanism at unlocked position.
Figure 7:
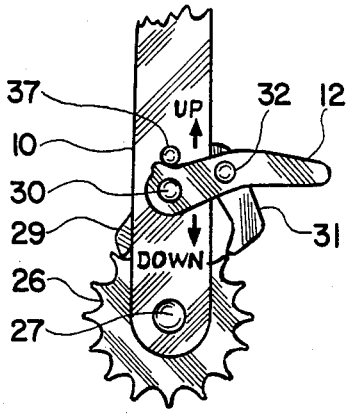
FIG. 7 illustrates a view of the frictionally controlled cord release device showing the manual switch of the ratchet mechanism.

In FIG. 5 there is illustrated another cross section of the frictionally controlled cord release device illustrated in FIG. 3 taken along plane 5—5 as shown in FIG. 3. The ratchet stop 29 pivotably supported by the shaft 30 affixed to the frame of the frictionally controlled cord release device engages and disengages the teeth of the ratchet gear or sprocket 26 depending on whether the manual ratchet switch 12 shown in FIG. 3 is at the "up" or "lock" position, or at the "down" or "unlock" position. The ratchet stop 29 illustrated in FIG. 5 is located at the "up" or "lock" position set there by means of the manual ratchet switch 12 shown in FIG. 3 or by means of the remotely controlled ratchet switch 31. The one extremity of the remotely controlled ratchet switch 31 is linked to the one extremity of the ratchet stop 29 opposite to the other extremity engaging the teeth of the ratchet gear or sprocket 26 by a pivoting hinge 32, wherein the pivoting axis 30 of the ratchet stop 29 is located intermediate the other extremity of the ratchet stop 29 engaging the teeth of the ratchet gear or sprocket 26 and the pivoting hinge 32, while the other extremity of the remotely contro11ed ratchet switch 31 is in contact with the teeth of the ratchet gear or sprocket 26. The pivoting movement of the remotely controlled ratchet switch 31 about the pivoting hinge 32 and relative to the ratchet stop 29 is limited by a stop 33 affixed to the ratchet stop 29 in one direction, while it is biased by the spring 34 in the other direction, wherein the spring 34 is installed in such a way that the rotation of the ratchet gear or sprocket 26 in the clockwise direction in the particular embodiment shown in FIG. 5 tends to disengage the ratchet stop 29 from the teeth of the ratchet gear or sprocket 26 and, consequently, the ratchet stop 29 remains disengaged during the rotation of the ratchet gear or sprocket 26 in the clockwise direction once the ratchet stop 29 is disengaged from the teeth of the ratchet gear or sprocket 26 by means of the manual switch 12. The spring biased ball detent 35 secured to the frame of the frictionally controlled cord release device insures that the ratchet stop 29 is either at the fully engaged or fully disengaged positions, but not at any intermediate position therebetween. In FIG. 6 there is illustrated the same cross section of the frictionally controlled cord release device as that illustrated in FIG. 5, which now shows the ratchet stop 29 switched to the "down" or "unlock" position, which is set there by means of the manual ratchet switch 12 that is shown in FIG. 3 and described in conjunction with FIG. 7. In FIG. 7 there is illustrated a view of the frictionally controlled cord release device illustrated in FIG. 3, which is viewed through plane 7—7 as shown in FIG. 3. The manual ratchet switch 12 pivotable about the shaft 30 defining the pivoting axis of the ratchet stop 29 shifts the hinge axis 32 pivotably connecting the remotely controlled ratchet switch 31 to the ratchet stop 29 to the "up" or "lock" position or to the "down" or "unlock" position, which engages or disengages the ratchet stop 29 from the teeth of the ratchet gear or sprocket 26. The spring biased ball detent 37 may be included in place of or in addition to the spring biased ball detent 35 shown in FIGS. 5 and 6.

Figure 8:
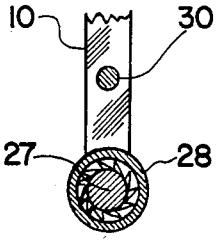
FIG. 8 illustrates a further cross section of the frictionally controlled cord release device illustrated in FIG. 3.

In FIG. 8 there is illustrated a further cross section of the frictionally controlled cord release device illustrated in FIG. 3, which cross section is taken along plane 8—8 as shown in FIG. 3. The ratchet coupling 28 nonrotatably coupled to the hollow brake cylinder 23 links the hollow brake cylinder 23 to the shaft 27 in such a way that the hollow brake cylinder 23 is rotatable in one direction only, which direction is the counter clockwise direction in the particular embodiment shown in FIG. 8.

In order to understand the operating principles of the vertical mobility device shown in FIG. 1 that employs the frictionally controlled cord release illustrated in FIGS. 3, 4, 5, 6, 7 and 8, it is necessary to understand the operation and function of the ratchet mechanism illustrated in FIGS. 5, 6 and 7. The ratchet stop 29 shifts to the "lock" position wherein the ratchet stop 29 engages the teeth of the ratchet gear or sprocket 26 as illustrated in FIG. 5, when the manual switch 12 shown in FIG. 7 is shifted to the "up" position or the combination of the hollow cylindrical member 22 and the plurality of the brake pads 25, that is nonrotatably connected to the ratchet gear or sprocket 26, is rotated in the counter clockwise direction activating the remotely controlled ratchet switch 31 that pushes up the hinge 32 to the "up" position. When the ratchet stop 29 engages the teeth of the ratchet gear or sprocket 26 as shown in FIG. 5, the combination of the hollow cylindrical member 22 and the plurality of brake pads 25 is rotatable in the counter clockwise direction only, which rotating movement in the counter clockwise direction takes up the cord member 4 and releases the cord member 7. When the ratchet stop 29 disengages the teeth of the ratchet gear or sprocket 26 as shown in FIG. 6, as the manual switch 12 shown in FIG. 7 is shifted to the "down" position, the combination of the holow cylinder 22 and the plurality of the brake pads 25 is rotatable in both directions and, consequently, the closed loop of cord 1 can be looped in both directions.

The vertical mobility device illustrated in FIG. 1 operates in the following principles: When the ratchet stop 29 is made to engage the teeth of the ratchet gear or sprocket 26 by means of the manual ratchet switch 12 or by means of the remotely controlled ratchet switch 31, the squeezable tubular brake assembly comprising the hollow cylindrical member 22 and the plurality of the brake pads 25 is freely rotatable in one direction resulting in the take up of the cord member 4 and the release of the cord member 7, while it is not rotatable in the other opposite direction. When the ratchet stop 29 is made to disengage from the ratchet gear or sprocket 26 by means of the manual switch 12, the squeezable tubular brake assembly comprising the hollow cylindrical member 22 and the plurality of the brake pads 25 is rotatable in both directions. The tension created by the weight of the person 6 secured to the cord member 3 squeezes the plurality of the brake pads 25 against the cylindrical surface of the hollow brake cylinder 23 and, consequently, generates a braking force substantially proportional to the weight of the person 6 in magnitude. The friction coefficient between the brake pads 25 and the hollow brake cylinder 23 can be selected in such a way that the braking force is substantially proportional to and slightly less that the amount required to suspend the person 6 secured to the cord member 3 in midair. It is evident that the person 6 wearing the harness 5 secures oneself to the cord member 3 by securing the harness 5 to the securing means 4 and then lowers oneself at a safe speed by executing hand over hand movements in releasing the cord member 7 as one descends, which descending process is virtually effortless. Upon completing the descending, the person 6 frees oneself from the harness 5 and pulls down the cord member 7, which sends the harness 5 back to the upper level whereupon a next person descends. In general, the weight 13 is not required when the vertical mobility device is used for descending only. The person 6 secured to the cord member 3 can propel oneself upwardly by using the stirrup 8 with a locking means that grabs the cord member 7 when the weight of the person 6 is shifted from the harness 5 to the stirrup 8 as that person stands thereon, while the stirrup 8 slides substantially freely on the cord member 7 when it does not support any weight. By repeating the combination of the movements of pulling up the stirrup by bending the knees while seating on the harness and standing up on the stirrup by straightening oneself, the person 6 can elevate oneself with ease. The weight 13 maintains the taut state for the cord member 7, which helps the upward sliding movement of the stirrup 8 relative to the cord member 7. The weight 13 may be omitted as a person standing on the lower level can provide a tension on the cord member 7 that maintains the taut state thereof. Upon completion of the ascending, one may disengage the ratchet stop 29 from the ratchet gear or sprocket 26 by means of the manual ratchet switch 12 and descends at a safe speed wherein one can control one's descending speed by maintaining a small amount of tension on the cord member 7 or by applying a small amount of pressure on the stirrup or removing therefrom. Upon landing on the lower level, one can reengage the ratchet stop 29 to the ratchet gear or sprocket 26 by pulling down the cord member 7, whereupon the vertical mobility device is ready for another execution of the climbing act.

Figure 9:
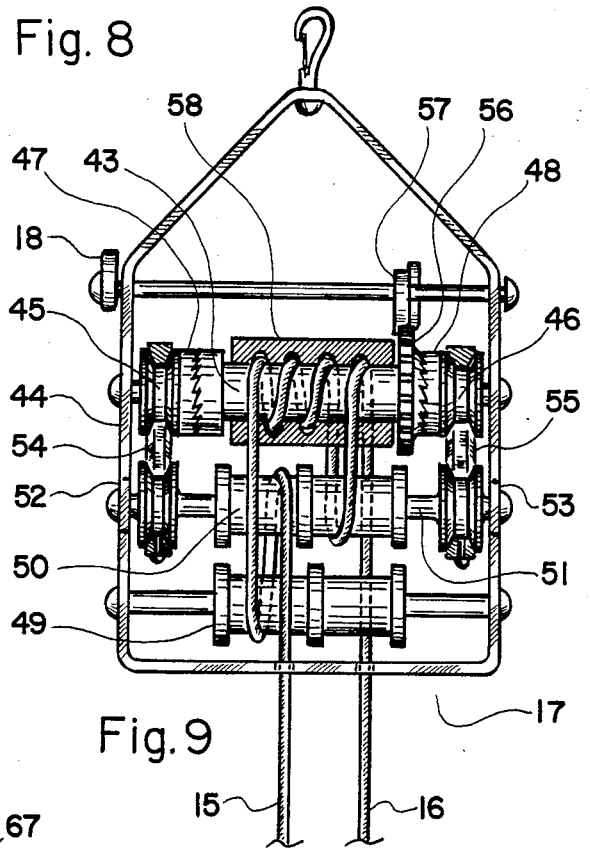
FIG. 9 illustrates a cross section of an embodiment of another frictionally controlled cord release device employed in the vertical mobility device illustrated in FIG. 2.

In FIG. 9 there is illustrated the construction of the frictionally controlled cord release device 17 employed in the construction of the vertical mobility device illustrated in FIG. 2. It should be noticed that the illustration of the frictionally controlled cord release device shown in FIG. 9 is viewed in a direction opposite to the one shown in FIG. 2. A first cylindrical member or capstan 43 is rotatably and nonshiftably secured to the frame 44. The two extremities of the first cylindrical member 43 are respectively coupled to a pair of brake wheels or drums 45 and 46 by means of a pair of ratchet couplings 47 and 48, respectively, wherein the brake wheels or drums 45 and 46 are nonrotatably coupled to the first cylindrical member or capstan 43 in one direction, while the formers are rotatable relative to the latter in the other direction. A second cylindrical member 49 is rotatably and nonshiftably secured to the frame 44 in a parallel relationship with respective to the first cylindrical member 43. A third cylindrical member 50 is rotatably and shiftably secured to the frame 44 intermediate the first cylindrical member 43 and the second cylindrical member 49 in a parallel configuration thereto, as the shaft 51 rotatably supporting the third cylindrical member 50 is retained within a pair of slotted holes 52 and 53 included in the frame 44. A pair of braking cords or belts 54 and 55 anchored to the shaft 51 are looped or wound around the brake wheels or drums 45 and 46, respectively. A ratchet gear or sprocket nonrotatably coupled to the first cylindrical member 43 is engaged by a ratchet stop 57 including a manual ratchet switch 18. The combination of the ratchet gear or sprocket 56, the ratchet stop 57 and the manual ratchet switch 18 are constructed and assembled in essentially the same way as that illustrated in FIGS. 5, 6 and 7, which are described in conjunction therewith. The cord member constituting the closed loop of cord 14 is wound on the first cylindrical member 43 over at least one and one half complete laps, wherein one cord member is looped around the second cylindrical member 49 and the third cylindrical member 50 in that order wherefrom the cord member extends as cord member 15, while the other cord member is looped around the third cylindrical member and the first cylindrical member in that order wherefrom the cord member extends as the cord member 16. The hollow cylindrical cord guide 58 disposed around the first cylindrical member 43 guides the cord member wound therearound.

The vertical mobility device illustrated in FIG. 2 employing the frictionally controlled cord release device 17 illustrated in FIG. 9 operates in the following principles: The weight of person secured to the cord member 15 by means of the harness 19 pulls down the third cylindrical member 50 away from the first cylindrical member 43, which action produces frictional braking on the brake wheels or drums 45 and 46 that is slightly less than the amount of braking required to suspend the person in midair motionlessly. Such a braking system can be constructed by employing braking surfaces of a proper friction coefficient. The person secured to the cord member 15 by means of the harness 19 can remain suspended in midair or descend at a safe speed by exerting a small amount of tension on the cord member 16. The vertical mobility device illustrated in FIG. 2 also enables a person to propel oneself upwards when it includes a stirrup 20 with a locking means slidably secured to the cord member 16, which stirrup grabs the cord member 16 when the person secured to the cord member 15 exerts one's weight on the stirrup by stepping thereon, while the stirrup slides freely on the cord member 16 when it does not support any sizable weight. When the person secured to the cord member 15 shifts one's weight to the stirrup 20, the cord member 16 is released from the frictionally controlled cord release device 17, while the cord member 15 is taken up thereby, as the first cylindrical member 43 is substantially freely rotatable in one direction releasing the cord member 16 and taking up cord member 15 in virtue of the ratchet couplings 47 and 48 and/or in virtue of the deactivation of the braking imposed by the braking drums 45 and 46. It should be understood that the frictionally controlled cord release device 17 functions with or without the ratchet couplings 47 and 48. By repeating the combination of the movements of pulling up the stirrup 20 by bending the knees while resting one's weight on the harness 19 and standing up straight on the stirrup 19 while maintaining a small amount of tension on the cord member 16, one can propel oneself upwards with ease. Ascending with the vertical mobility device is made even easier when the ratchet stop 57 is made to engage the ratchet gear or sprocket 56 by means of the manual ratchet switch 18 or by pulling down the cord member 16 which action activates the ratchet system as described in conjunction with FIGS. 5, 6 and 7. When the ratchet system is activated, the first cylindrical member 43 is rotatable only in a direction wherein the cord member 15 is taken up by and the cord member 16 is released from the frictionally controlled cord release device 17. It should be understood that the ratchet system is strictly an option as the vertical mobility device functions with or without the ratchet system including the ratchet gear or sprocket 56 and the ratchet stop 57.

Figure 10:
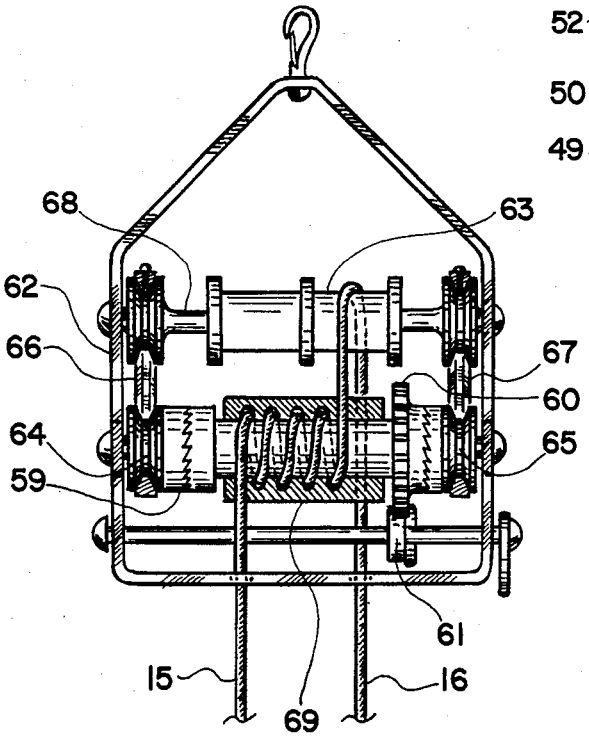
FIG. 10 illustrates a cross section of an embodiment of a further frictionally controlled cord release device usable in place of the element shown in FIG. 9.

In FIG. 10 there is illustrated another embodiment of the frictionally controlled cord release device usable in place of the one illustrated in FIG. 9. A first cylindrical member 59 including a ratchet gear or sprocket 60 engaged by a ratchet stop 61 is rotatably and shiftably secured to the frame 62. A second cylindrical member 63 is rotatably and nonshiftably secured to the frame 62 in a parallel relationship with respect to the first cylindrical member 59. The two extremities of the first cylindrical member 59 are respectively coupled to the brake drums or wheels 64 and 65 around which the brake cords or belts 66 and 67 are wound, which brake cords are anchored to the shaft 68 rotatably supporting the second cylindrical member 63. The ratchet switch mechanism and the coupling between the first cylindrical member 59 and brake wheels or drums 64 and 65 are arranged in essentially the same way as those described in conjunction with FIG. 9. The cord member is wound on the first cylindrical member 59 over at least one complete lap wherein one portion extends therefrom as the cord member 15, while the other portion is looped around the second cylindrical member 63 wherefrom it extends as the cord member 16. The hollow cylindrical cord guide 69 guides the cord member wound on the first cylindrical member 59. The frictionally controlled cord release device illustrated in FIG. 10 operates in the same principles as that described in conjunction with FIG. 9.

Figure 11:
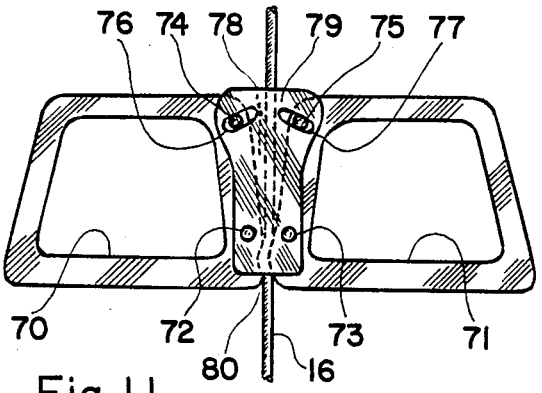
FIG. 11 illustrates an embodiment of the stirrup employed in the vertical mobility device of the present invention.

In FIG. 11 there is illustrated an embodiment of the stirrup usable in conjunction with the vertical mobility device of the present invention. A pair of foot-rests 70 and 71 are disposed on a common plane wherein the foot-rests 70 and 71 are respectively pivotable about the two pivoting axes 72 and 73. The pivoting movements are guided by the pins 74 and 75 respectively engaging a pair of slotted holes 76 and 77 included in a pair of holder plates 78 and 79. The passage of the cord member 16 intermediate the pair of the foot-rests 70 and 71 and the pair of the holder plates 78 and 79 includes a pinch point 80 that grabs the cord member 16 by pinching action when the sitrrup is stepped on A curved path for the cord member 16 is included at the pinch point 80 to enhance the grabbing action. The stirrup slides freely on the cord member 16 when it does not support any sizable weight. The stirrup may be slidably secured to the cord member 16 permanently or removably. The construction of the stirrup illustrated in FIG. 11 is one of many designs that provides the required functions, which designs are considered strictly as matters of design.

While the principles of the present invention have now been made clear by the illustrative embodiments there will be immediately obvious to the skilled in the art many modifications of the structures, arrangement, proportions, elements and materials which are particularly adapted to the specific working environments and operating conditions in the practice of the invention without departing from those principles.

We claim:

1. A vertical mobility device for transporting a person or object in vertical directions comprising in combination:

(a) a cylindrical member rotatably secured to a supporting structure including a means for securing said supporting structure to an elevated structure; said clindrical member including a braking means for hindering rotating movement of said cylindrical member;

(b) a cord member wound on said cylindrical member over at least one complete lap wherein one portion of said cord member and the other portion of said cord member extend from said cylindrical member;

(c) a shiftable actuator means for actuating said braking means "to provide a braking force approximately proportional to the weight of said person or object" has been inserted after "braking means", said actuator means movably engaged by said one portion and said the other portion of said cord member, wherein said actuator means activates said braking means when pull on said one portion of said cord member is greater than pull on said the other portion of said cord member and generates braking on the rotating movements of said cylindrical member of magnitude substantially porportional to and slightly less than the difference in pulls on said one portion and said the other portion of said cord members, and said actuator means deactivates said braking means when pull on said one portion of said cord member is less than pull on said the other portion of said cord member;

(d) cord guide means for guiding cord member wound on said cylindrical member wherein said cord guide means enhances smooth looping movements of said cord member resulting from the rotating movement of said cylindrical member;

(e) a ratchet mechanism linked to said cylindrical member, said ratchet mechanism preventing said cylindrical member from rotating in a direction resulting in looping motion of said cord member releasing said one portion of said cord member and taking up said the other portion of said cord member when said ratchet mechanism is activated;

(f) means for activating and deactivating said ratchet mechanism, said means operatable by a manual shifting mechanism; and (g) at least one securing means affixed to said one portion of said cord member for securing a harness;

whereby, a person or persons wearing a harness secured to said at least one securing means affixed to said one portion of said cord member can remain suspended in midair or lower oneself at a safe speed by exterting a small amount of pull on said the other portion of said cord member as said braking plus said small amount of pull on said the other portion of said cord member substantially counter balances pull on said one portion of said cord member created by the weight of said person or persons secured to said one portion of said cord member when said ratchet mechanism is deactivated.

2. The combination as set forth in claim 1 wherein said combination includes at least one harness secured to said at least one securing means affixed to said one portion of said cord member.

3. The combination as set forth in claim 2 wherein extremity of said one portion of said cord member is connected to extremity of said the other portion of said cord member, wherein said cord member forms a closed loop of cord depending from the combination of said cylindrical member and said actuator means.

4. The combination as set forth in claim 3 wherein said means for activating and deactivating said ratchet mechanism is operatable by pulling said the other portion of said cord member.

5. The combination as set forth in claim 2 wherein said combination includes at least one stirrup means slidably secured to said the other portion of said cord member, said at least one stirrup means including a pressure activated grip means, wherein said pressure activated grip means grabs said cord member in a nonslidable relationship when said at least one stirrup means is stepped on, while said at least one stirrup means slides substantially freely on said cord member when said at least one stirrup means is not stepped on; whereby, a person wearing said harness secured to said securing means affixed to said one portion of said cord member elevates oneself by repeating the combination of movements of standing up on said at least one stirrup means and then pulling up said at least one stirrup means by bending knees as said ratchet mechanism at activated state allows looping movement of said closed loop of cord in one direction only that results in take up of said one portion of said cord member and release of said the other portion of said cord member.

6. The combination as set forth in claim 5 wherein extremity of said one portion of said cord member is connected to extremity of said the other portion of said cord member, wherein said cord member forms a closed loop of cord depending from the combination of said cylindrical member and said actuator means.

7. The combination as set forth in claim 6 wherein said means for activating and deactivating said ratchet mechanism is operatable by pulling said the other portion of said cord member.

8. A vertical mobility device for transporting a person or object in vertical directions comprising in combination :

(a) a first cylindrical member rotatably and nonshiftably secured to a supporting structure including a means for securing said supporting structure to an elevated structure;

(b) a second cylindrical member rotatably and nonshiftably secured to said supporting structure in a substantially parallel configuration with respect to said first cylindrical member;

(c) a third cylindrical member rotatably and shiftably secured to said supporting structure intermediate said first and second cylindrical members in a substantially parallel configuration with respect to said first cylindrical member;

(d) a cord member wound on said first cylindrical member over at least one complete lap, wherein one portion of said cord member extending from one side of the cylindrical surface of said first cylindrical member loops over the combination of said third and first cylindrical members over at least one complete loop, and the other portion of said cord member extending from the other side of the cylindrical surface of said first cylindrical member loops over the combination of said second and third cylindrical members over at least one complete loop;

(f) cord guide means for guiding said cord member wound on said first cylindrical member wherein said cord guide means enhances smooth looping movements of said cord member;

(g) a ratchet mechanism linked to said cylindrical member, said ratchet mechanism preventing said cylindrical member from rotating in a direction resulting in looping motion of said cord member releasing said one portion of said cord member and taking up said the other portion of said cord member when said ratchet mechanism is activated;

(h) means for activating and deactivating said ratchet mechanism, said means operatable by a manual shifting mechanism; and (i) at least one securing means affixed to said one portion of said cord member for securing a harness; whereby, a person or persons wearing a harness secured to said at least one securing means affixed to said one portion of said cord member can remain suspended in midair or lower oneself at a safe speed by exterting a small amount of pull on said the other portion of said cord member as said braking plus said small amount of pull on said the other portion of said cord member substantially counter balances pull on said one portion of said cord member created by the weight of said person or persons secured to said one portion of said cord member when said ratchet mechanism is deactivated.

9. The combination as set forth in claim 8 wherein said combination includes at least one harness secured to said at least one securing means affixed to said one portion of said cord member.

10. The combination as set forth in claim 9 wherein extremity of said one portion of said cord member is connected to extremity of said the other portion of said cord member, wherein said cord member forms a closed loop of cord depending from the combination of said cylindrical members.

11. The combination as set forth in claim 10 wherein said means for activating and deactivating said ratchet mechanism is operatable by pulling said the other portion of said cord member.

12. The combination as set forth in claim 9 wherein said combination includes at least one stirrup means slidably secured to said the other portion of said cord member, said at least one stirrup means including a pressure activated grip means, wherein said pressure activated grip means grabs said cord member in a non-slidable relationship when said at least one stirrup means is stepped on, while said at least one stirrup means slides substantially freely on said cord member when said at least one stirrup means is not stepped on; whereby, a person wearing said harness secured to said securing means affixed to said one portion of said cord member elevates oneself by repeating the combination of movements of standing up on said at least one stirrup means and then pulling up said at least one stirrup means by bending knees as said ratchet mechanism at activated state allows looping movement of said closed loop of cord in one direction only that results in take up of said one portion of said cord member and release of said the other portion of said cord member.

13. The combination as set forth in claim 12 wherein extremity of said one portion of said cord member is connected to extremity of said the other portion of said cord member, wherein said cord member forms a closed loop of cord depending from the combination of said cylindrical members.

14. The combination as set forth in claim 13 wherein said means for activating and deactivating said ratchet mechanism is operatable by pulling said the other portion of said cord member.

* * * * *